US011616346B2

(12) United States Patent
Ito et al.

(10) Patent No.: US 11,616,346 B2
(45) Date of Patent: Mar. 28, 2023

(54) SPARK PLUG

(71) Applicant: NGK SPARK PLUG CO., LTD., Nagoya (JP)

(72) Inventors: Kazuki Ito, Nagoya (JP); Hiroaki Izawa, Nagoya (JP); Kengo Hattori, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/792,599

(22) PCT Filed: Aug. 19, 2021

(86) PCT No.: PCT/JP2021/030309
§ 371 (c)(1),
(2) Date: Jul. 13, 2022

(87) PCT Pub. No.: WO2022/044940
PCT Pub. Date: Mar. 3, 2022

(65) Prior Publication Data

US 2023/0064238 A1 Mar. 2, 2023

(30) Foreign Application Priority Data

Aug. 24, 2020 (JP) ..... JP2020-140536

(51) Int. Cl.
*H01T 13/39* (2006.01)
*C22C 5/04* (2006.01)
*H01T 13/32* (2006.01)

(52) U.S. Cl.
CPC ..... *H01T 13/39* (2013.01); *C22C 5/04* (2013.01); *H01T 13/32* (2013.01)

(58) Field of Classification Search
CPC ..... H01T 13/32; H01T 13/39
(Continued)

(56) References Cited

U.S. PATENT DOCUMENTS 8,810,120 B2 8/2014 Sumoyama et al.
2014/0015964 A1 1/2014 Chew et al.
(Continued)

FOREIGN PATENT DOCUMENTS

DE 102020134129 A1 * 7/2021 ..... H01T 13/20
DE 112021001025 T5 * 12/2022
(Continued)

OTHER PUBLICATIONS

International Search Report from corresponding International Patent Application No. PCT/JP21/30309, dated Oct. 26, 2021.

*Primary Examiner* — Christopher M Raabe
(74) *Attorney, Agent, or Firm* — Kusner & Jaffe

(57) ABSTRACT

A spark plug having a center electrode that includes a columnar noble metal tip at one end thereof, and a ground electrode that forms a spark gap between the ground electrode and a circular discharge surface of the tip. In the tip, a mass % of Pt is largest and a content percentage of Ni is more than or equal to 0 mass % and less than or equal to 40 mass %. In each of both a cross-section of the tip parallel to the discharge surface and a cross-section of the tip perpendicular to the discharge surface, particles each having an aspect ratio of more than or equal to 1 and less than or equal to 10 occupy more than or equal to 70% of observed particles in an area extending from an outline of the cross-section by a distance of 10% of a diameter of the discharge surface.

2 Claims, 10 Drawing Sheets

(58) Field of Classification Search
USPC ..... 313/141
See application file for complete search history.

(56) References Cited

U.S. PATENT DOCUMENTS

| | | | | |
|---|---|---|---|---|
| 2018/0166863 | A1* | 6/2018 | Sumoyama, Sr. ..... | H01T 13/32 |
| 2021/0203135 | A1* | 7/2021 | Shibata ..... | H01T 13/32 |

FOREIGN PATENT DOCUMENTS

| | | | |
|---|---|---|---|
| JP | 8-045643 | A | 2/1996 |
| JP | 2003-007422 | A | 1/2003 |
| JP | 2007-227188 | A | 9/2007 |
| JP | 2013-30388 | A | 2/2013 |
| JP | 2016-225053 | A | 12/2016 |

* cited by examiner

SPARK PLUG

FIELD OF THE INVENTION

The present invention relates to a spark plug.

BACKGROUND OF THE INVENTION

As an ignition spark plug to be used in an internal combustion engine, for example, a gasoline engine, a spark plug that generates spark by applying a voltage between a center electrode and a ground electrode is known (for example, see Japanese Unexamined Patent Application Publication No. 2013-30388, hereinafter "PTL 1").

PTL 1 discloses a spark plug in which a noble metal tip is provided at the front end of a center electrode and, as materials of the noble metal tip, iridium (Ir) and rhodium (Rh) are used.

However, Ir and Rh are expensive materials and not necessarily accepted in every market. Thus, development of a noble metal tip having durability while suppressing the use amounts of Ir and Rh has been desired.

SUMMARY OF THE INVENTION

The present invention has been made to solve the aforementioned problems and can be realized in the following forms.

(1) According to one form of the present invention, a spark plug is provided. The spark plug includes a center electrode that includes a columnar noble metal tip at one end thereof, and a ground electrode that forms a spark gap between the ground electrode and a circular discharge surface of the noble metal tip. In the noble metal tip, a mass % of Pt is largest and a content percentage of Ni is more than or equal to 0 mass % and less than or equal to 40 mass %. In each of both a cross-section of the noble metal tip parallel to the discharge surface and a cross-section of the noble metal tip perpendicular to the discharge surface, particles each having an aspect ratio of more than or equal to 1 and less than or equal to 10 occupy more than or equal to 70% of observed particles in an area extending from an outline of the cross-section by a distance of 10% of a diameter of the discharge surface. According to the spark plug in this form, in each of both the cross-section of the noble metal tip parallel to the discharge surface and the cross-section of the noble metal tip perpendicular to the discharge surface, the particles each having the aspect ratio of more than or equal to 1 and less than or equal to 10 occupy more than or equal to 70% of the observed particles in the area extending from the outline of the cross-section by the distance of 10% of the diameter of the discharge surface. It is thereby possible to suppress occurrence of uneven erosion of the noble metal tip and, as the results, possible to suppress separation of the noble metal tip from the center electrode. Therefore, durability of the noble metal tip is improved.

(2) In the spark plug in the aforementioned form, in each of both the cross-section of the noble metal tip parallel to the discharge surface and the cross-section of the noble metal tip perpendicular to the discharge surface, the particles each having the aspect ratio of more than or equal to 1 and less than or equal to 10 may occupy more than or equal to 70% of the observed particles in an entirety of the cross-section. According to the spark plug in this form, it is possible to suppress occurrence of uneven erosion of the noble metal tip effectively. Therefore, durability of the noble metal tip is further improved.

Note that the present invention can be realized in various forms. For example, the present invention can be realized in a form of a method of manufacturing a spark plug, a form of an engine head to which a spark plug is attached, and the like.

DETAILED DESCRIPTION OF INVENTION

A. First Embodiment

Figure 1:
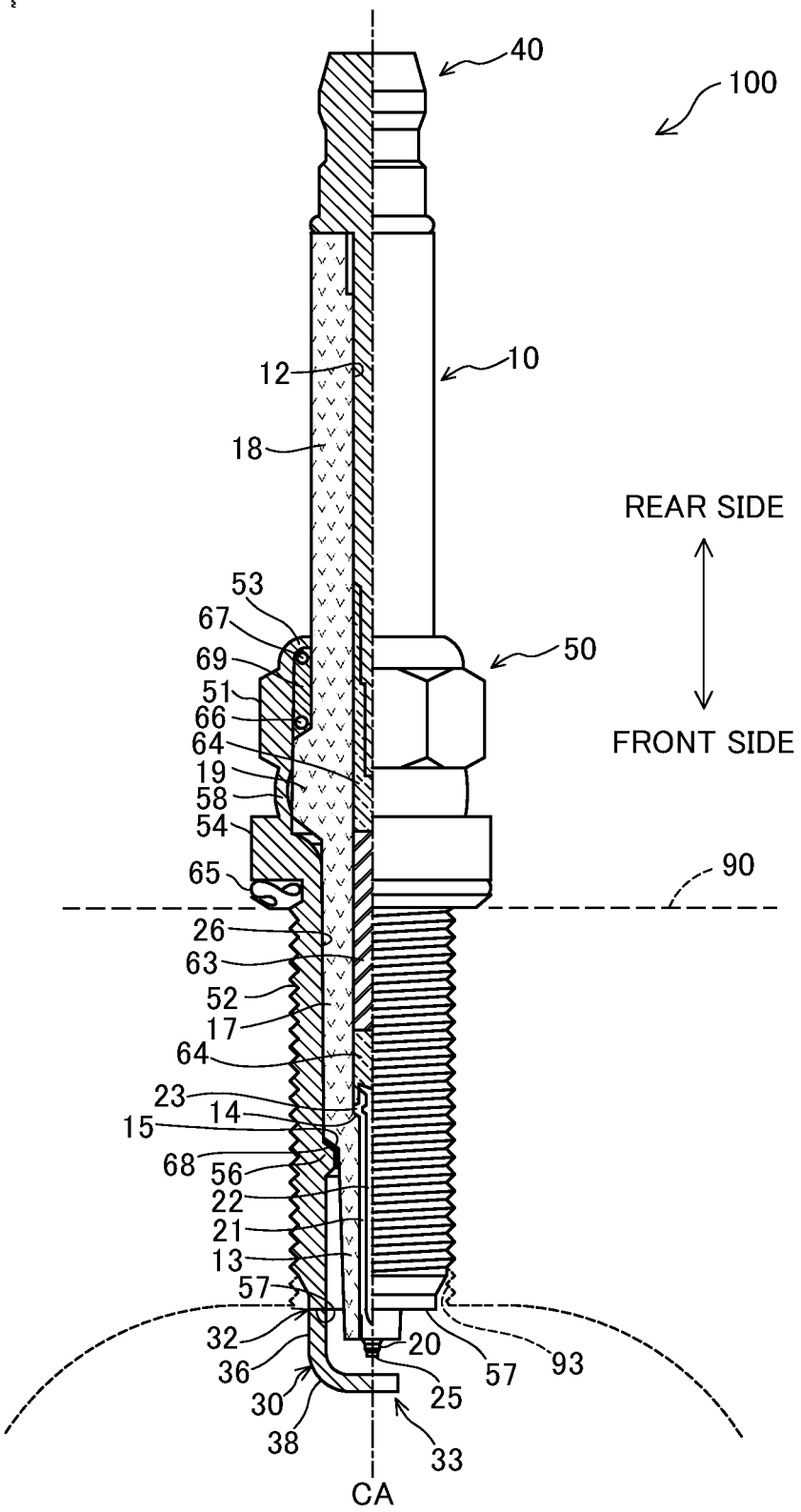
FIG. 1 is an explanatory view illustrating a partial cross-section of a spark plug.

FIG. 1 is an explanatory view illustrating a partial cross-section of a spark plug 100. In FIG. 1, an appearance shape of the spark plug 100 is illustrated on the right side, and a sectional shape of the spark plug 100 is illustrated on the left side with an axial line CA, which is the shaft center of the spark plug 100, as a boundary. In the description of the present embodiment, the lower side in FIG. 1 is referred to as the front end side of the spark plug 100, and the upper side in FIG. 1 is referred to as the rear end side of the spark plug 100.

The spark plug 100 includes an insulator 10 having an axial hole 12 along the axial line CA, a center electrode 20 provided in the axial hole 12, a cylindrical metal shell 50 disposed at the outer periphery of the insulator 10, and a ground electrode 30 disposed with a gap between the ground electrode 30 and the center electrode 20. The axial line CA of the spark plug 100 coincides with the axial line of the center electrode 20.

The insulator 10 is a ceramic insulator that is formed by baking a ceramic material, such as alumina. The insulator 10 is a member disposed at the inner periphery of the metal shell 50 and is a cylindrical member having, at the center thereof, the axial hole 12 in which a portion of the center electrode 20 is housed on the front end side and a portion of a metal terminal 40 is housed on the rear end side. At the middle of the insulator 10 in the axial direction, a central trunk portion 19 having a large outer diameter is formed. On the rear end side of the central trunk portion 19, a rear trunk portion 18 having an outer diameter smaller than the outer diameter of the central trunk portion 19 is formed. On the front end side of the central trunk portion 19, a front trunk portion 17 having an outer diameter smaller than the outer diameter of the rear trunk portion 18 is formed. On the further front end side of the front trunk portion 17, a leg portion 13 having an outer diameter that becomes smaller toward the center electrode 20 is formed.

The metal shell 50 is a cylindrical metal shell that surrounds and holds a part extending from a portion of the rear trunk portion 18 of the insulator 10 to the leg portion 13. The metal shell 50 is formed of, for example, low-carbon steel, and the entirety thereof has been subjected to plating such as nickel plating, zinc plating, or the like. The metal shell 50 includes, in order from the rear end side, a tool engagement portion 51, a seal portion 54, and an attaching screw portion 52. A tool for attaching the spark plug 100 to an engine head 90 is to be engaged with the tool engagement portion 51. The attaching screw portion 52 is a part of the outer periphery of the metal shell 50 where an external screw is formed on the whole circumference and is a part that is to be screwed into an attaching screw hole 93 of the engine head 90. The seal portion 54 is formed in a flange shape at a base portion of the attaching screw portion 52. Between the seal portion 54 and the engine head 90, an annular gasket 65 formed by bending a plate body is fitted. An end face 57 of the metal shell 50 on the front end side has a hollow circular shape. From the middle of the end face 57, the front end of the leg portion 13 of the insulator 10 and the front end of the center electrode 20 project.

On the rear end side of the tool engagement portion 51 of the metal shell 50, a crimping portion 53 having a thin thickness is provided. Between the seal portion 54 and the tool engagement portion 51, a compression deformation portion 58 having a thin thickness similarly to the crimping portion 53 is provided. Between the inner peripheral surface of the metal shell 50 and the outer peripheral surface of the rear trunk portion 18 of the insulator 10 in a part from the tool engagement portion 51 to the crimping portion 53, annular ring members 66 and 67 are interposed, and powder of talc 69 is charged between these ring members 66 and 67. In the manufacture of the spark plug 100, the crimping portion 53 is bent inward to be pressed toward the front end side, and the compression deformation portion 58 is thereby compression deformed. Due to the compression deformation of the compression deformation portion 58, the insulator 10 is pressed inside the metal shell 50 toward the front end side via the ring members 66 and 67 and the talc 69. Then, this pressing compresses the talc 69 in the direction of the axial line CA, thereby increasing airtightness inside the metal shell 50.

In the metal shell 50, a metal-shell inner step portion 56 protruding at the inner periphery is formed. In the insulator 10, an insulator step portion 15 that is positioned at the rear end of the leg portion 13 and that protrudes at the outer periphery is formed. At the inner periphery of the metal shell 50, the metal-shell inner step portion 56 is in contact with the insulator step portion 15 via an annular packing 68. The packing 68 is a member that keeps airtightness between the metal shell 50 and the insulator 10 and avoids outflow of a combustion gas. In the present embodiment, a plate packing is used as the packing.

A base end 32 of the ground electrode 30 is fixed to the end face 57 of the metal shell 50. The ground electrode 30 includes a base end portion 36 that extends from the base end 32 toward the front end side, a facing portion 33 that has a face facing the front end of the center electrode 20, and a bent-shaped bent portion 38 that connects the base end portion 36 and the facing portion 33 to each other. The ground electrode 30 is formed of nickel as a main component. A core material excellent in thermal conductivity compared with a surface portion of the ground electrode 30 may be embedded in the inside of the ground electrode 30. The core material may be formed of, for example, copper or an alloy containing copper as a main component. A face of the facing portion 33 facing the front end of the center electrode 20 may be provided with a noble metal tip. The noble metal tip may be formed of noble metal as a main component. For example, platinum, iridium, ruthenium, rhodium, an alloy thereof, and the like are examples of noble metal.

The center electrode 20 is a rod-shaped member in which a core material 22 excellent in thermal conductivity compared with an electrode member 21 is embedded in the inside of the electrode member 21. The electrode member 21 is formed of a nickel alloy containing nickel as a main component. The core material 22 is formed of copper or an alloy containing copper as a main component. The core material 22 may be omitted.

In the vicinity of an end portion of the center electrode 20 on the rear end side, a flange portion 23 protruding on the outer peripheral side is formed. The flange portion 23 is in contact from the rear end side with an axial-hole inner step portion 14 that protrudes on the inner peripheral side in the axial hole 12 of the insulator 10. The flange portion 23 positions the center electrode 20 inside the insulator 10. The center electrode 20 is electrically connected on the rear end side of the center electrode 20 to the metal terminal 40 via a seal body 64 and a ceramic resistor 63.

The center electrode 20 includes a columnar noble metal tip 25 at one end. Specifically, a face of the center electrode 20, the face facing the ground electrode 30, is provided with the columnar noble metal tip 25. A discharge surface of the noble metal tip 25 is circular. Between the circular discharge surface of the noble metal tip 25 and the ground electrode 30, a spark gap is formed.

In the noble metal tip 25, the mass % of platinum (Pt) is largest and the content percentage of nickel (Ni) is more than or equal to 0 mass % and less than or equal to 40 mass %. From the point of view of being excellent in durability, in the noble metal tip 25, it is preferable that the content percentage of Pt be more than or equal to 75 mass % and less than or equal to 92 mass % and the content percentage of Ni be more than or equal to 8 mass % and less than or equal to 25 mass %, it is more preferable that the content percentage of Pt be more than or equal to 78 mass % and less than or equal to 90 mass % and the content percentage of Ni be more than or equal to 10 mass % and less than or equal to 22 mass %, and it is further preferable that the content percentage of Pt be more than or equal to 80 mass % and less than or equal to 85 mass % and the content percentage of Ni be more than or equal to 15 mass % and less than or equal to 20 mass %. In the present embodiment, the content percentage of Pt is 80 mass % and the content percentage of Ni is 20 mass % in the noble metal tip 25.

Figure 2:
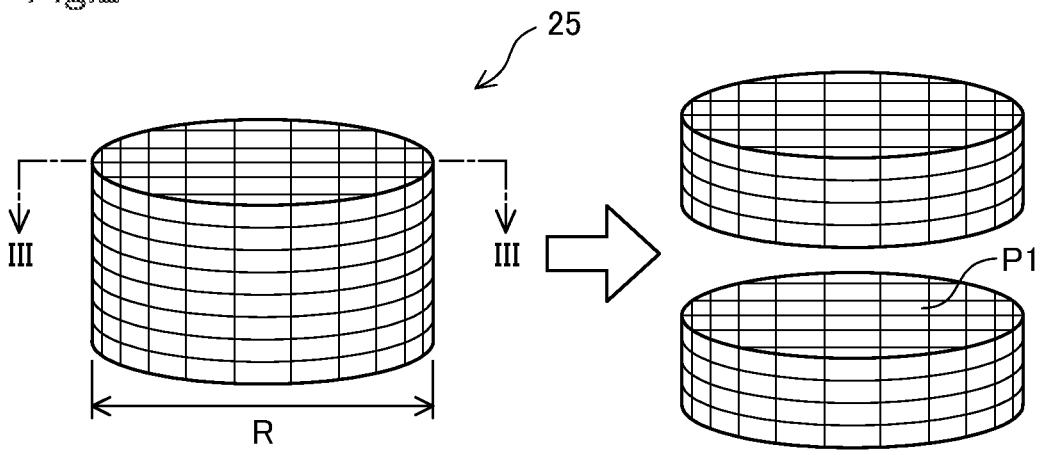
FIG. 2 is a perspective view schematically illustrating a general configuration of a noble metal tip.

FIG. 2 is a perspective view schematically illustrating a general configuration of the noble metal tip 25. For convenience of description, a state in which the noble metal tip 25 is cut parallel to the discharge surface is illustrated on the right side in FIG. 2. The cross-section illustrated in FIG. 2 passes through the middle of the noble metal tip 25 in the thickness direction. For convenience of illustration, among metal crystal particles constituting the noble metal tip 25, particles P1, which will be described later, each having an aspect ratio of more than or equal to 1 and less than or equal to 10 are illustrated in a grid form in FIG. 2. In the following description, the diameter of the discharge surface of the noble metal tip 25 is referred to as a diameter R. If the discharge surface of the noble metal tip 25 is not completely circular, the "diameter R of the discharge surface" denotes the short diameter of the discharge surface.

Figure 3:
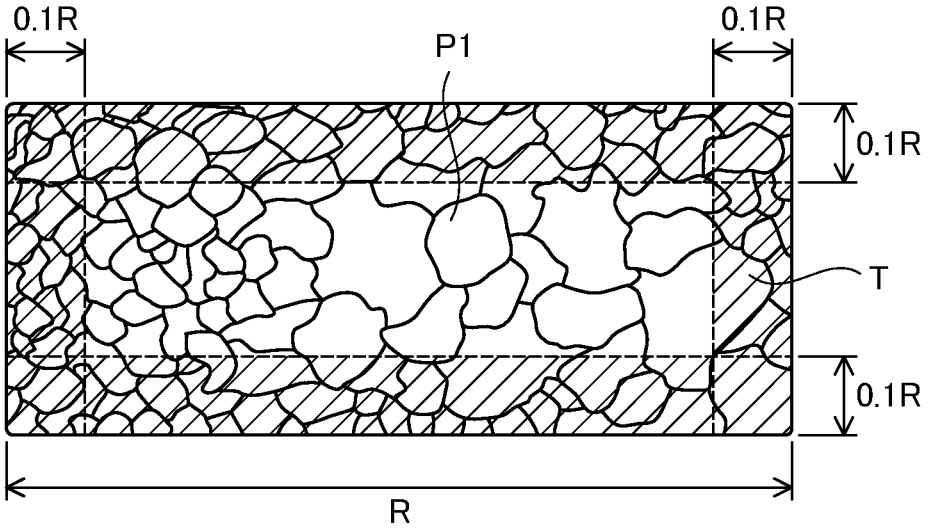
FIG. 3 is a schematic sectional view illustrating a cross-section of a noble metal tip perpendicular to a discharge surface.

FIG. 3 is a schematic sectional view illustrating a cross-section of the noble metal tip 25 perpendicular to the discharge surface. The cross-section illustrated in FIG. 3 is a cross-section along line III-III of FIG. 2 and is a cross-section passing through the center axis of the noble metal tip 25. As illustrated in FIG. 3, in the present embodiment, when an area extending from the outline of the cross-section by a distance of 10% of the diameter R of the discharge surface is referred to as an area T, the particles P1 each having an aspect ratio of more than or equal to 1 and less than or equal to 10 occupy more than or equal to 70% of observed particles in the area T. Also in the cross-section of the noble metal tip 25 parallel to the discharge surface illustrated in FIG. 2, the particles P1 each having an aspect ratio of more than or equal to 1 and less than or equal to 10 occupy more than or equal to 70% of observed particles in the area T extending from the outline of the cross-section by a distance of 10% of the diameter R of the discharge surface. From the point of view of improving the durability of the noble metal tip 25, the percentage of the particles P1 in the area T is preferably more than or equal to 80%, more preferably more than or equal to 85%, and further preferably more than or equal to 90% in each of both the cross-section parallel to the discharge surface and the cross-section perpendicular to the discharge surface. In the noble metal tip 25 in the present embodiment, the particles P1 each having an aspect ratio of more than or equal to 1 and less than or equal to 10 occupy more than or equal to 70% of observed particles also in an area on the inner side of the area T in each of both the cross-section parallel to the discharge surface and the cross-section perpendicular to the discharge surface. From the point of view of improving the durability of the noble metal tip 25, the percentage of the particles P1 in the area on the inner side of the area T is preferably more than or equal to 80%, more preferably more than or equal to 85%, and further preferably more than or equal to 90% in each of both the cross-section parallel to the discharge surface and the cross-section perpendicular to the discharge surface.

Aspect ratios can be measured by the following method. First, after a surface is polished by a cross-section processing device (cross-section polisher (CP)) based on an ion-milling method, an image by a SEM (scanning electron microscope) or an image by a SEM using an EBSD (electron channeling pattern) method is obtained. Thereafter, based on the image, rectangles each including a particle are drawn by a later-described method, and then, aspect ratios (the length of a long side/the length of a short side) are calculated.

Figure 4:
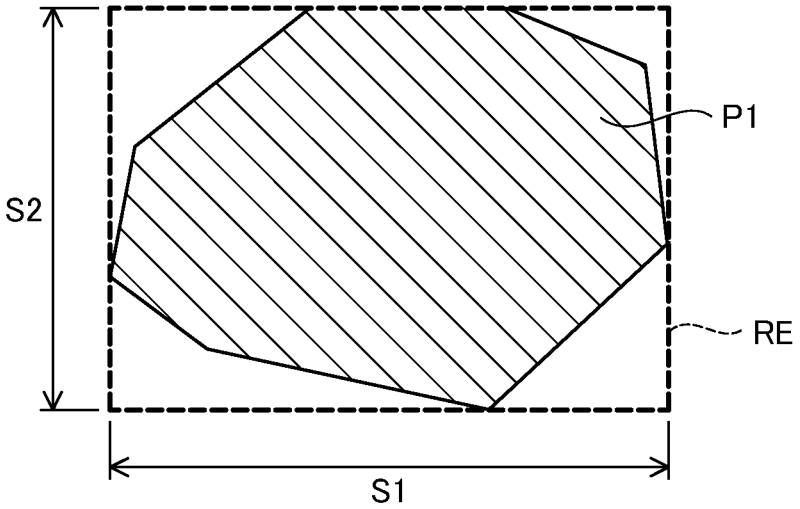
FIG. 4 is a view describing a method of measuring a long side and a short side of a particle.

FIG. 4 is a view describing a method of measuring a long side S1 and a short side S2 of each particle P1. As illustrated in FIG. 4, first, a smallest rectangle RE including the particle P1 is drawn. That is, the four sides of the rectangle RE are each in contact with the contour of the particle P1. Here, in a cross-section perpendicular to a discharge surface, the direction of the rectangle RE is a direction in which the long side S1 or the short side S2 of the rectangle RE is parallel to the outline of the noble metal tip 25. It is sufficient that at least one side of the rectangle RE is parallel to the outline indicating the discharge surface of the noble metal tip 25. In a cross-section parallel to the discharge surface, the direction of the rectangle RE does not matter from the point of view of symmetric properties. However, the rectangles drawn for respective particles P1 are all directed in the same direction. In other words, it is sufficient that, when any two rectangles are selected from a plurality of rectangles, one side of one of the rectangles and one side of the other of the rectangles are parallel to each other.

The crystal particles of the particles P1 each having an aspect ratio of more than or equal to 1 and less than or equal to 10 are granular and form a granular structure. Due to the particles P1 occupying more than or equal to 70% of observed particles in the area T, the durability of the noble metal tip 25 is improved. This mechanism will be presumed by using a comparative example having a configuration in which the percentage of the particles P1 each having an aspect ratio of more than or equal to 1 and less than or equal to 10 is less than 70% in the area T.

Figure 5:
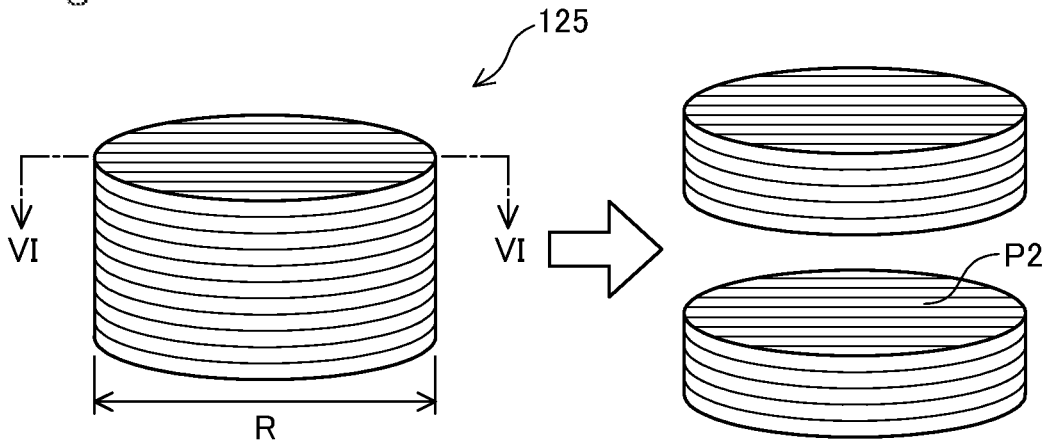
FIG. 5 is a perspective view schematically illustrating a general configuration of a noble metal tip in a comparative example.

FIG. 5 is a perspective view schematically illustrating a general configuration of a noble metal tip 125 in the comparative example. For convenience of description, a state in which the noble metal tip 125 is cut parallel to a discharge surface is illustrated on the right side in FIG. 5. The cross-section illustrated in FIG. 5 passes through the middle of the noble metal tip 125 in the thickness direction. For convenience of illustration, among metal crystal particles constituting the noble metal tip 125, particles P2 each having an aspect ratio of greater than 10 are illustrated in a lateral stripe form in FIG. 5.

Figure 6:
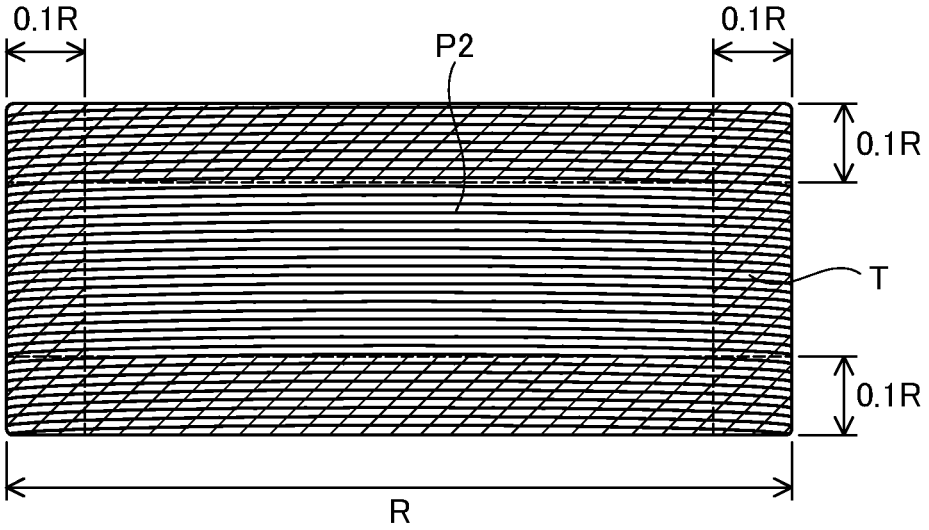
FIG. 6 is a schematic sectional view of a noble metal tip in a comparative example.

FIG. 6 is a schematic sectional view of the noble metal tip 125 in the comparative example. Similarly to the cross-section illustrated in FIG. 3, the cross-section illustrated in FIG. 6 is a cross-section perpendicular to the discharge surface of the noble metal tip 125. In the area T of the noble metal tip 125 in the comparative example, the particles P1 each having an aspect ratio of more than or equal to 1 and less than or equal to 10 is less than 70% of observed particles, and the particles P2 each having an aspect ratio greater than 10 is more than or equal to 30% of the observed particles. In the noble metal tip 125 in the comparative example, the particles P2 each having an aspect ratio of greater than 10 occupy approximately 100% of the observed particles in the area T. For example, a noble metal tip created by punching a rolled alloy into a columnar shape is an example of the noble metal tip 125 in the comparative example. Crystal particles in such a tip are stretched in a rolling direction, and thus, parallel crystal grain boundaries are formed.

Figure 7:
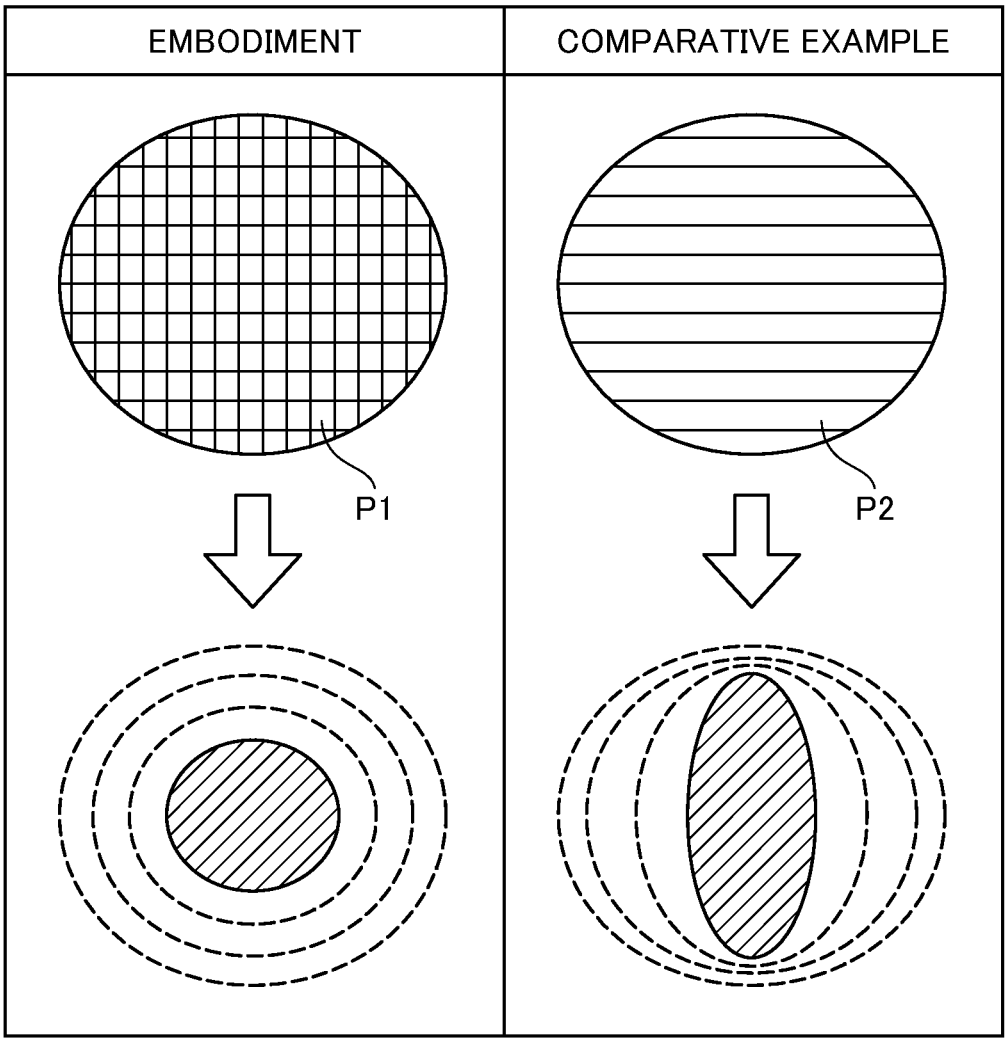
FIG. 7 is a view describing a difference in durability between a noble metal tip in the present embodiment and a noble metal tip in a comparative example.

FIG. 7 is a view describing a difference in durability between the noble metal tip 25 in the present embodiment and the noble metal tip 125 in the comparative example. On the left upper side in FIG. 7, a cross-section of the noble metal tip 25 in the present embodiment parallel to the discharge surface is illustrated, and on the left lower side in FIG. 7, the shape of the noble metal tip 25 after long time use is illustrated. On the right upper side in FIG. 7, a cross-section of the noble metal tip 125 in the comparative example parallel to the discharge surface is illustrated, and on the left lower side in FIG. 7, the shape of the noble metal tip 125 in the comparative example after long time use is illustrated. In FIG. 7, among the particles constituting the noble metal tip 25 or 125, the particles P1 each having an aspect ratio of more than or equal to 1 and less than or equal to 10 are illustrated in a grid form and the particles P2 each having an aspect ratio of greater than 10 are illustrated in a lateral stripe form in the cross-section parallel to the discharge surface of the noble metal tip 25 or 125. In FIG. 7, the outlines of the noble metal tips 25 and 125 in a state of being eroded are illustrated by broken lines.

Generally, due to being away from the center of a combustion chamber more than the front end of the ground electrode 30, each of the noble metal tips 25 and 125 provided, as illustrated in FIG. 1, at the front end of the center electrode 20 has a lower temperature during use than the front end of the ground electrode 30. As the results, each of the noble metal tips 25 and 125 is eroded while the shapes of crystal grains are relatively maintained. Since the melting point of crystal grain boundaries is locally low compared with the crystal grains, the crystal grain boundaries are eroded in priority to the crystal grains. The degree of erosion of the side surface, which is in a situation in which oxidation in the chamber is severe, of each of the noble metal tips 25 and 125 is larger than the degree of erosion of the front end of each of the noble metal tips 25 and 125 due to spark discharge.

In the noble metal tip 25 in the present embodiment, in each of both the cross-section of the noble metal tip 25 parallel to the discharge surface and the cross-section of the noble metal tip 25 perpendicular to the discharge surface, the particles P1 each having an aspect ratio of more than or equal to 1 and less than or equal to 10 occupy more than or equal to 70% of observed particles in the area T extending from the outline of the cross-section by a distance of 10% of the diameter R. Since the anisotropy of the crystal structure of the particles P1 each having an aspect ratio of more than or equal to 1 and less than or equal to 10 is small, the directions of the crystal grain boundaries are in a random state in the area T of the noble metal tip 25. Therefore, as illustrated in FIG. 7, the noble metal tip 25 in the present embodiment is eroded evenly in the circumferential direction of the noble metal tip 25. In other words, erosion of the noble metal tip 25 in the present embodiment proceeds along with the use of the spark plug 100 toward the inner side in the radial direction substantially concentrically. In contrast, since the anisotropy of the crystal structure in the noble metal tip 125 in the comparative example is large, the noble metal tip 125 is not eroded evenly in the circumferential direction of the noble metal tip 125, and uneven erosion occurs. More specifically, due to the crystal grain boundaries being eroded in priority, erosion proceeds in a direction in which the boundaries extend. That is, in the noble metal tip 125 in the comparative example, the degree of erosion that proceeds toward the inner side in the radial direction is not even in the circumferential direction. As the results, the noble metal tip 125 in the comparative example is unevenly eroded along with use and may be separated from the center electrode 20 in an early stage even when the volume of the noble metal tip 125 remains sufficiently. In contrast, in the noble metal tip 25 in the present embodiment, as the results of occurrence of uneven erosion being suppressed, separation from the center electrode 20 is suppressed. Thus, the durability of the noble metal tip 25 is improved. Therefore, it is possible to increase the life of the spark plug 100.

In the noble metal tip 25 in the present embodiment, the mass % of Pt is largest and the content percentage of Ni is more than or equal to 0 mass % and less than or equal to 40 mass %. Thus, material costs can be reduced compared with a noble metal tip in which the content percentages of iridium (Ir) and rhodium (Rh) are large. As the results, it is possible to reduce the costs of the spark plug 100. In addition, since the content percentage of Pt is largest, the noble metal tip 25 is excellent in workability compared with a noble metal tip in which the content percentages of Ir, Rh, and Ni are large. It is thus possible to manufacture the noble metal tip 25 by punching instead of wire cutting and possible to reduce processing costs. As the results, it is possible to reduce the costs of the spark plug 100. Therefore, according to the spark plug 100 in the present embodiment, is it possible to suppress an increase in the costs required for the manufacture of the spark plug 100 while suppressing a decrease in the durability of the noble metal tip 25.

For example, although not particularly limited, the following method is an example of a method of manufacturing the noble metal tip 25 in the present embodiment. That is, an example is a method in which a thin plate obtained by rolling an alloy is punched into a columnar shape and then subjected to heat treatment. Here, the heat treatment is different depending on the thickness and the composition of the noble metal tip 25. For example, a method in which heating at 800° C. to 1000° C. is performed for about 1 hour to 10 hours in an atmosphere (for example, argon atmosphere) in which Pt and Ni are not oxidized is an example. It is considered that, by performing such heat treatment, it is possible to recrystallize crystal whose aspect ratio is increased by rolling and possible to control the shapes of crystal particles. When the aforementioned punching is performed, large processing distortion is generated in the vicinity of the outer peripheral surface of the noble metal tip 25. The vicinity is thus recrystallized in priority during heat treatment.

B. Second Embodiment

Figure 8:
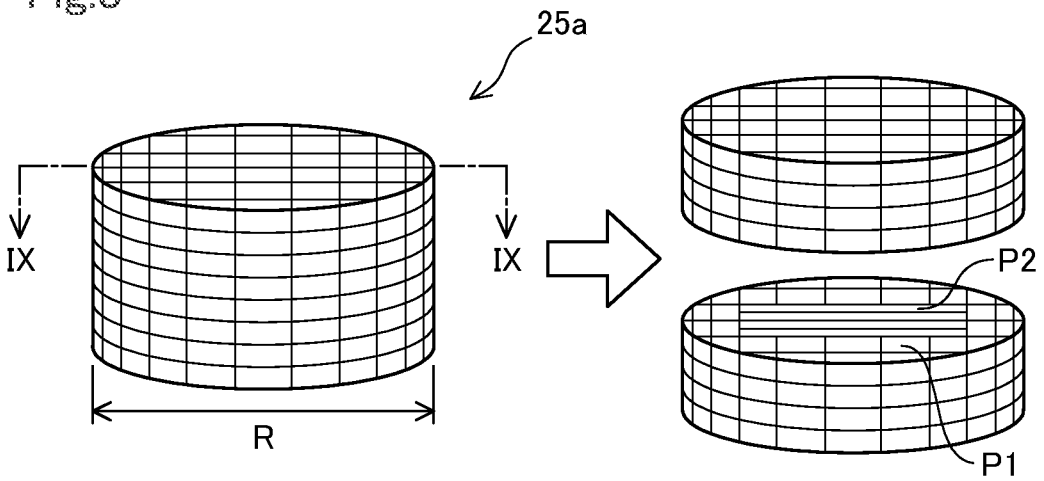
FIG. 8 is a perspective view schematically illustrating a general configuration of a noble metal tip in a second embodiment.

FIG. 8 is a perspective view schematically illustrating a general configuration of a noble metal tip 25*a* in a second embodiment. For convenience of description, a state in which the noble metal tip 25*a* is cut parallel to a discharge surface is illustrated on the right side in FIG. 8. The cross-section illustrated in FIG. 8 passes through the middle of the noble metal tip 25*a* in the thickness direction. For convenience of illustration, among metal crystal particles constituting the noble metal tip 25*a*, the particles P1, which will be described later, each having an aspect ratio of more than or equal to 1 and less than or equal to 10 are illustrated in a grid form in FIG. 8. Among the metal crystal particles constituting the noble metal tip 25*a*, the particles P2 each having an aspect ratio of greater than 10 is illustrated in a lateral stripe form in FIG. 8.

Figure 9:
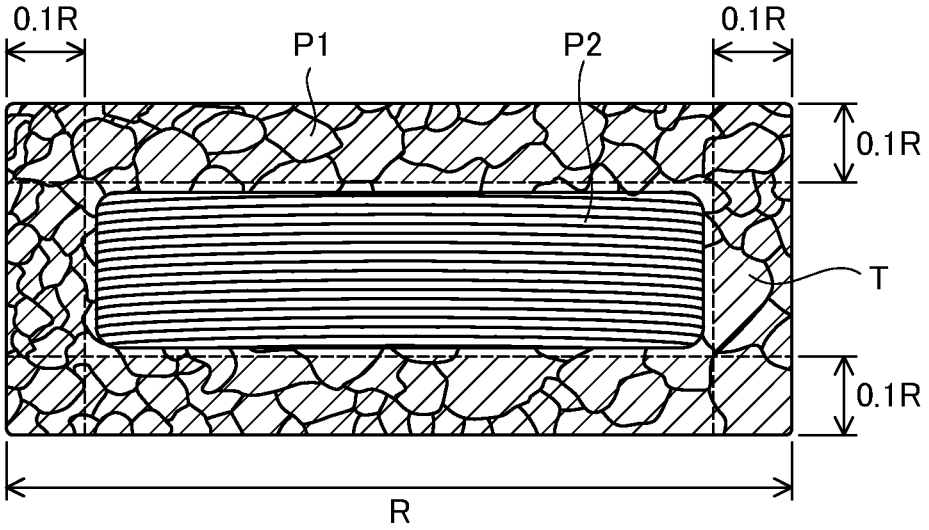
FIG. 9 is a schematic sectional view illustrating a cross-section of a noble metal tip in the second embodiment perpendicular to a discharge surface.

FIG. 9 is a schematic sectional view illustrating a cross-section of the noble metal tip 25*a* in the second embodiment perpendicular to the discharge surface. In the noble metal tip 25*a* in the second embodiment, as illustrated in FIG. 8 and FIG. 9, in each of both a cross-section of the noble metal tip 25*a* parallel to the discharge surface and a cross-section of the noble metal tip 25*a* perpendicular to the discharge surface, the particles P1 each having an aspect ratio of more than or equal to 1 and less than or equal to 10 occupy more than or equal to 70% of observed particles in an area extending from the outline of the cross-section by a distance of 10% of the diameter R. Meanwhile, in the noble metal tip 25*a* in the second embodiment, the percentage of the particles P1 in observed particles is less than 70% in an area on the inner side of the area T extending from the outline of the cross-section by a distance of 10% of the diameter R.

Figure 10:
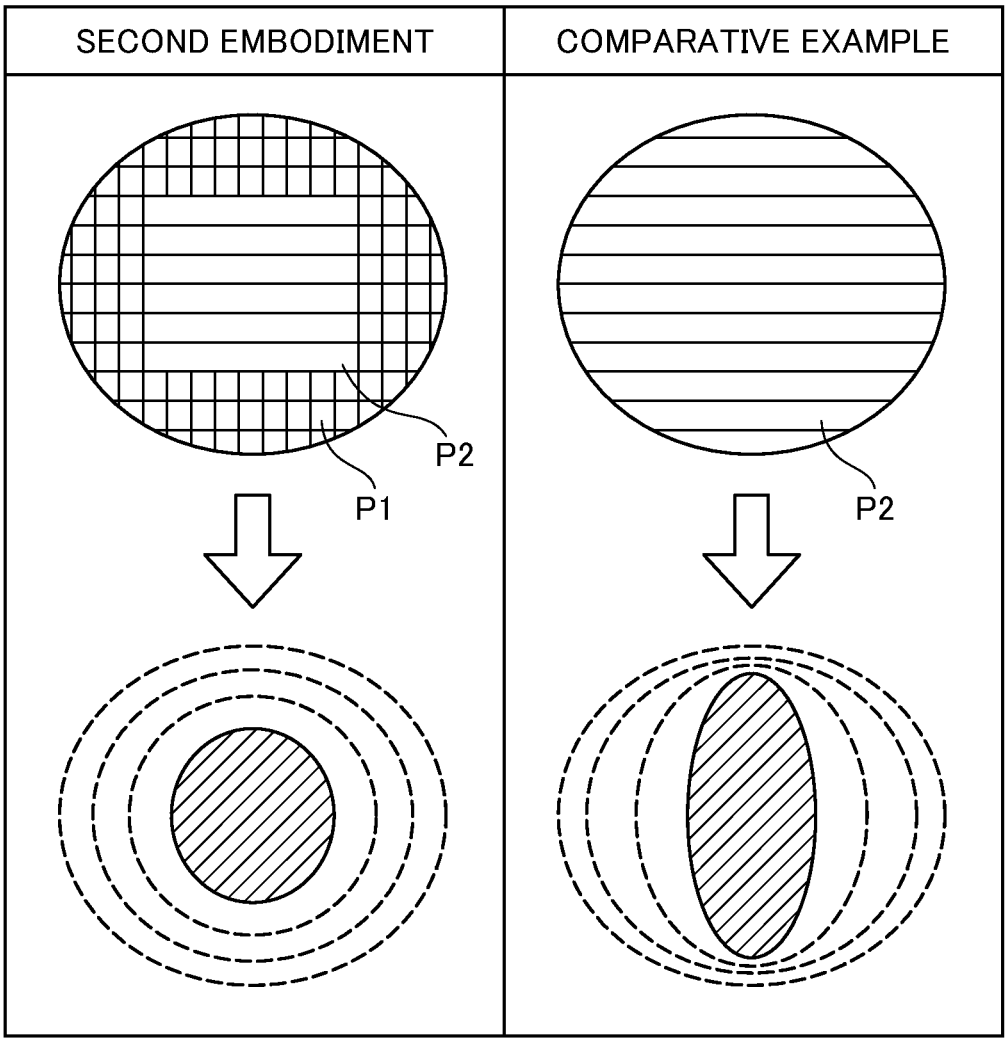
FIG. 10 is a view describing a difference in durability between a noble metal tip in the second embodiment and a noble metal tip in a comparative example.

FIG. 10 is a view describing a difference in durability between the noble metal tip 25*a* in the second embodiment and the noble metal tip 125 in the above-described comparative example. On the left upper side in FIG. 10, a cross-section of the noble metal tip 25*a* in the second embodiment parallel to the discharge surface is illustrated, and on the left lower side in FIG. 10, the shape of the noble metal tip 25*a* after long time use is illustrated. In FIG. 10, among the particles constituting the noble metal tip 25*a* or 125, the particles P1 each having an aspect ratio of more than or equal to 1 and less than or equal to 10 are illustrated in a grid form and the particles P2 each having an aspect ratio of greater than 10 are illustrated in a lateral stripe form in the cross-section of the noble metal tip 25*a* or 125 parallel to the discharge surface. In FIG. 10, the outlines of the noble metal tips 25*a* and 125 in a state of being eroded are illustrated by broken lines.

Also in the noble metal tip 25*a* in the second embodiment, the particles P1 each having an aspect ratio of more than or equal to 1 and less than or equal to 10 occupy more than or equal to 70% of observed particles in an area extending from the outline of the cross-section by a distance of 10% of the diameter R. Thus, in the noble metal tip 25*a*, the particles P1 in which directivity of a crystal structure is small occupy the most part of the surface of the noble metal tip 25*a*. Here, erosion of the noble metal tip 25*a* proceeds along with use from the surface toward the inside thereof. Thus, it is possible also in the noble metal tip 25*a* in the second embodiment, similarly to the noble metal tip 25 in the first embodiment, to suppress erosion from proceeding unevenly in the circumferential direction. Therefore, it is possible also in the configuration of the second embodiment to improve the durability of the noble metal tip 25*a*.

For example, although not particularly limited, a method in which a thin plate obtained by rolling an alloy is punched into a columnar shape and then subjected to heat treatment for a shorter period or at a lower temperature than in the above-described heat treatment is an example of the method of manufacturing the noble metal tip 25*a* in the second embodiment.

C. Other Embodiment

The present invention is not limited to the above-described embodiments. The present invention can be realized by various configurations within a range not departing from the gist of the present invention. For example, the technical features in the embodiments corresponding to the technical features in the forms described in Summary of Invention can be replaced and combined, as appropriate, to solve some or all of the above-described problems or to achieve some or all of the above-described effects. Moreover, the technical features can be deleted, as appropriate, unless otherwise described in the present description to be essential.

REFERENCE SIGNS LIST

10 insulator
12 axial hole
13 leg portion
14 axial-hole inner step
15 insulator step portion
17 front trunk portion
18 rear trunk portion
19 central trunk portion
20 center electrode
21 electrode member
22 core material
23 flange portion
25, 25*a* noble metal tip
30 ground electrode
32 base end
33 facing portion
36 base end portion
38 bent portion
40 metal terminal
50 metal shell
51 tool engagement portion
52 attaching screw portion
53 crimping portion
54 seal portion
56 metal-shell inner step portion
57 end surface
58 compression deformation portion
63 ceramic resistor
64 seal body
65 gasket
66, 67 ring member
68 packing
69 talc
90 engine head
93 attaching screw hole
100 spark plug
125 noble metal tip
CA axial line
P1 particle
P2 particle
R diameter
RE rectangle
S1 long side
S2 short side
T area

What is claimed is:

1. A spark plug comprising:

a center electrode that includes a columnar noble metal tip at one end thereof; and a ground electrode that forms a spark gap between the ground electrode and a circular discharge surface of the noble metal tip, wherein, in the noble metal tip, a mass % of Pt is largest and a content percentage of Ni is more than or equal to 0 mass % and less than or equal to 40 mass %, and wherein, in each of both a cross-section of the noble metal tip parallel to the discharge surface and a cross-section of the noble metal tip perpendicular to the discharge surface, particles each having an aspect ratio of more than or equal to 1 and less than or equal to 10 occupy more than or equal to 70% of observed particles in an area extending from an outline of the cross-section by a distance of 10% of a diameter of the discharge surface.

2. The spark plug according to claim 1, wherein, in each of both the cross-section of the noble metal tip parallel to the discharge surface and the cross-section of the noble metal tip perpendicular to the discharge surface, the particles each having the aspect ratio of more than or equal to 1 and less than or equal to 10 occupy more than or equal to 70% of the observed particles in an entirety of the cross-section.

* * * * *